US006191084B1

(12) United States Patent
Christianson

(10) Patent No.: US 6,191,084 B1
(45) Date of Patent: Feb. 20, 2001

(54) CHEMICAL COMPOSITION AND METHOD FOR CLEANING FLUID METERING PRINT ROLLERS

(75) Inventor: Lee A. Christianson, Musk., WI (US)

(73) Assignee: LBL Enterprises, LLC., Milwaukee, WI (US)

( * ) Notice: Under 35 U.S.C. 154(b), the term of this patent shall be extended for 0 days.

(21) Appl. No.: 09/590,197

(22) Filed: Jun. 8, 2000

Related U.S. Application Data

(63) Continuation-in-part of application No. 09/371,478, filed on Aug. 10, 1999, which is a continuation-in-part of application No. 09/151,310, filed on Sep. 11, 1998, now Pat. No. 5,948,740.

(51) Int. Cl.[7] ..... C11D 1/831; C11D 1/86

(52) U.S. Cl. ..... 510/171; 510/170

(58) Field of Search ..... 510/170, 171, 510/174

(56) References Cited

U.S. PATENT DOCUMENTS

| | | | | |
|---|---|---|---|---|
| 5,102,573 | * | 4/1992 | Han et al. | 252/153 |
| 5,437,686 | * | 8/1995 | Heffner et al. | 8/111 |
| 5,858,117 | * | 1/1999 | Oakes et al. | 134/27 |
| 5,993,562 | * | 11/1999 | Roelofs et al. | 134/7 |

* cited by examiner

*Primary Examiner*—John Hardee
(74) *Attorney, Agent, or Firm*—Marshall, O'Toole, Gerstein, Murray & Borun.

(57) ABSTRACT

A composition for cleaning a print roller such as an anilox roller includes a soap or cleansing agent having a plurality of grit particles, an organic acid, an emulsifier, and water. A solvent is mixed with the cleansing agent to complete the composition. A method of utilizing the cleaning composition includes providing the composition, selecting an applicator, and mixing the composition. The method then includes wiping the composition repeatedly over the print roller using the applicator until the surface and plurality of cells in the roller surface are substantially free of dried ink and other contaminants.

13 Claims, 2 Drawing Sheets

CHEMICAL COMPOSITION AND METHOD FOR CLEANING FLUID METERING PRINT ROLLERS

This is a CIP of U.S. application Ser. No. 09/371,478, Aug. 10, 1999, which is a CIP of U.S. application Ser. No. 09/151,310, filed Sep. 11, 1998, now U.S. Pat. No. 5,948, 740.

BACKGROUND OF THE INVENTION

1. Field of the Invention

The present invention relates generally to cleaning of printing equipment, and more particularly to a chemical composition and method for cleaning dried ink and other contaminants from a ceramic coated print roller such as an anilox roller utilized in a flexographic printing process.

2. Description of the Related Art

The flexographic printing process or flexography is a process of direct rotary printing of images onto an elongate moving web of material. The process is typically utilized for product packages and containers in many different industries. Anilox rollers utilized in the flexographic printing process have evolved considerably over the years. Anilox rollers typically come in three types of constructions. The first is a ceramic coating disposed over a knurled surface on a metal cylinder, the second is a chrome-plated surface over a knurled surface of a cylinder, and the third is a laser engraved ceramic surface on a cylinder. In each construction, a plurality of small or microscopic pockets or cells are formed in the coating material of the cylinder in order to carry the ink, adhesive or other coating material from the reservoir to the printing plate cylinder and then to the web. The size of the cells determines how much material each cell will carry. The anilox roller rotates and contacts the plate cylinder transferring the material in the cells to the plates. The engraving process for the cells can create different diameters, depths, shapes and placement angles of cells in order to meet the needs of a particular printing or other process.

Chrome and ceramic coated anilox rollers that are knurled and/or engraved typically can only have about 500 cells per inch because of the limitations of the technology for forming such a roller. Most printing requirements for today's industries require highly precise image and fluid transfer for which the coated knurled engravings are not well suited. Therefore, the laser engraved ceramic rollers offer many advantages over the other two types of anilox rollers. The cells of a laser engraved anilox roller can be formed having a density upwards of 1200 cells per inch with highly precise control of the shape, depth, size and steepness of the cell walls not capable in other anilox roller constructions. The depth and therefore volume of each laser engraved cell can be significant although the actual diameter or size of the cells can remain very small.

The laser engraved anilox rollers also offer much better durability than these other types of anilox rollers. However, the cost of such rollers is significantly greater because of the high precision manufacturing process necessary to produce the ceramic coated anilox roller. Another significant problem with the anilox rollers is the difficulty in cleaning dried ink or other dried or hardened substance residue from the surface and cells of the roller. This difficulty is caused by the very small microscopic size of the cells and the greater depth to which they are formed into the ceramic surface of the roller. Dried ink or other substances plugs the cells and is very difficult to remove from the anilox roller. The ink or material film flow quality is significantly decreased if an anilox roller is dirty and has clogged or plugged cells because the precision and volume of ink or other material transferred from the reservoir to the plate cylinder is reduced or altered. The metering function of the roller is thus inhibited. Dried ink can occur in all of the cells of the roller or only a portion of the cells depending upon the particular printing process being run. However, any dried ink or other substance occurring in any part of the roller surface causes reduced print quality and ink delivery.

There are a number of known methods and apparatuses utilized to clean anilox rollers. Some of these methods are quite effective while some methods are not. However, the effective methods as well as most of the ineffective methods are very costly, time consuming, require machine downtime and can cause damage to the anilox rollers.

For example, there are ultrasonic cleaners available whereby one or more anilox rollers are partially or completely submerged in a tank containing a highly caustic cleaning fluid. High frequency sound waves are generated in the caustic liquid medium to create microscopic air bubbles that implode on impact with the cells and the cell walls. The implosions force the caustic fluid into the cells to remove dried ink and other substance residue. This type of cleaning system is extremely expensive and is very time consuming. The ultrasonic cleaning equipment also requires its own maintenance, storage and upkeep. The caustic cleaning fluid requires special handling and storage and also requires time consuming and expensive precautionary safety measures be taken during the cleaning process. The use of the equipment requires that the anilox rollers be removed from the flexographic printing machine in order to be cleaned thus creating down time for the machine.

High-pressure cleaning systems are also sometimes utilized wherein an anilox roller is placed in a stream of a media ejected from a device at high pressure. The media can be a particle media such as small microscopic plastic particles or a sodium bicarbonate or baking soda specially designed to clean anilox rollers. The media can also be a cleaning liquid or fluid wherein jets or nozzles create an overlapping spray pattern impacting the anilox roller surface. Sometimes the cleaning liquid or fluid is heated to further facilitate cleaning. In some media blast systems, the roller is entirely submerged in the fluid media. Alternatively, some pressure wash systems rotate the roller in an ambient environment whereby a cleaning solution is ejected from nozzles toward the surface of the roller. In this type of system the rollers are not submerged in the cleaning media. Fluid pressure wash systems are less expensive in comparison to other hard media blast systems and when compared to ultrasonic systems. However, the media blast systems and the pressure wash systems are still relatively expensive and require maintenance, storage and upkeep of the equipment as well. Significant downtime of the flexographic printing machine also is necessary since the roller must typically be removed from the machine to be cleaned. There are a few media blast machines available that can attach directly to the flexographic press in order to clean the anilox roller on press. However, this type of machine must be attached and removed for each cleaning and is very cumbersome and expensive to operate and maintain. These machines also incorporate a large, high power vacuum or suction system to collect all of the media. The suction system is also very cumbersome and expensive.

Some cleaning systems utilize a pressurized vapor injection cleaning system wherein the rollers are placed in a stream of a vapor chemical composition. This type of system can be utilized directly on the flexographic machine because very little if any liquid is involved in the cleaning process. This system is fairly inexpensive and portable although again it requires maintenance and storage of the cleaning equipment and requires purchase and storage of the chemical vapor product as well. This type of system is not effective for all types of inks and coating materials and typically has not proven effective for heavy industrial printing processes where heavy and continuous cleaning is required for the anilox rollers.

Another type of system for cleaning anilox rollers involves utilizing the ink reservoir of the flexographic press for cleaning the cells of the anilox roller. This type of system is utilized where the ink is flushed out of the system and then a cleaning solution is replaced in the reservoir and utilized to clean out the cells. This type of system is relatively recent, expensive, and fairly ineffective at removing deeply embedded materials within the cells. A risk exists of not flushing out all of the cleaning solution from the system and then contaminating the subsequently run printing process. This type of self-contained system also requires significant machine downtime.

Manual cleaning is often utilized and even recommended for quick cleaning of anilox rollers. The manual cleaning process involves utilizing a wire brush for agitating ink on the surface and within the cells of the anilox roller. The brush is utilized along with a water based detergent or solvent based cleaner. The types of brushes typically utilized are brass or stainless steal bristle brushes wherein the stainless brushes are always utilized for ceramic rollers. This type of cleaning process is very messy, is very time consuming, can damage the ceramic coating if the wrong brush is used, and is limited in its effectiveness for the laser formed ceramic cells of modem anilox rollers. Most times the diameter of the brush bristles is much larger than the diameter of the cells and therefore the material deep within the cells cannot be readily dislodged.

All of these methods usually require removal of the anilox roller from the press prior to cleaning. Some rollers are on the order of sixty inches long or longer and can weigh upwards of a half a ton. A crane or hoist is often used to remove the larger rollers from the press and transport them to the cleaning apparatus or station. The removal is time consuming and requires significant downtime of the press. Manufacturers often recommend keeping a second replacement roller around for this very reason. However, some of the larger rollers can cost tens of thousands of dollars each. The ceramic surface of an anilox roller is very wear resistant and durable. However, the ceramic is also brittle and can be easily damaged upon impact with an object. Each removal of a roller for cleaning therefor also raises a risk of permanently damaging the roller surface.

Another commonly utilized method for cleaning anilox rollers is chemical cleaning whereby relatively harsh chemicals are utilized such as solvents, acids and common strong household cleaners which dissolve or re-wet the ink or other substances lodged within the cells. Chemical cleaning, as with virtually all cleaning methods first requires rinsing off or initially wiping the anilox roller to remove most of the wet ink or other substance from the last press run. Then the solution is applied and the anilox roller is wiped to completely cover the surface of the roller. The chemical compositions also require a dwell time so that the composition sits for a period of time on the rollers to react with the deeply embedded and dried substance plugging the cells. The anilox roller is then wiped down with the composition in order to clean the surface. A rinsing process must then be undertaken to remove all of the caustic chemical materials from the surface of the anilox roller as well as from the cells in order to prevent any unwanted residue from fouling up a subsequent print process.

A drawback with this type of method is that the rolls must again be removed from the flexographic printing machine so that the chemicals do not contaminate any other portion of the processed components. A further drawback is that this method requires a number of time consuming steps. These steps include: removing the roller from the press; quick cleaning the roller to remove most of the wet ink from the last print job; applying the chemical composition to the roller; letting the composition and roller dwell for a period of time; wiping the roller to clean it of dried ink; cleaning the chemical composition from the roller; rinsing the roller with water; and, replacing the roller on the press. Another drawback is that this type of cleaning has been found to be ineffective for deeply embedded and dried ink from within the cells of the roller. The advent of the much more expensive and time consuming cleaning methods discussed above are a result of the ineffectiveness of these chemical solution cleaning methods.

SUMMARY OF THE INVENTION

The present invention is directed to a chemical composition and a method of using the composition for easily cleaning anilox rolls thoroughly and inexpensively. One object of the present invention is to provide a chemical composition for cleaning an anilox roller while eliminating the need for utilizing expensive equipment to clean such a roller. Another object of the present invention is to provide a composition that requires fewer steps for cleaning dried ink or other dried or hardened substances from an anilox roller. A further object of the present invention is to provide a composition that thoroughly and completely cleans such dried ink or substances from the plugged cells of an anilox roller. A further object of the present invention is to provide a composition that requires essentially no waiting time for the composition to work in cleaning an anilox roller. A still further object of the present invention is to provide a method of cleaning an anilox roller that is simpler and less expensive than other known methods. A further object of the present invention is to provide a method for cleaning an anilox roller that requires fewer steps and takes less time than prior known methods. Another object of the present invention is to provide a method of cleaning an anilox roller that requires very little downtime of a flexographic printing machine.

To achieve these and other objects of the present invention, a composition in one embodiment comprises a cleansing agent and a solvent mixed together. The cleansing agent comprises an emulsifier, a plurality of grit particles, an organic acid and water. The grit particles aid to loosen or break free the dried ink and other contaminants on the roller that is wetted by the composition.

In one embodiment, the composition also may contain a deodorizer or other agent to alter the odor of the composition in order to provide a more pleasant or tolerable odor.

In one embodiment, one or more ammonium chlorides are provided in small amounts as a part of the cleansing agent. In one embodiment, the grit particles are small particles of silica in an amount of at least about 20% of the cleansing agent.

In one embodiment, the organic acid is a sulfonicacid and is provided in a range of between about 3% and 15% of the cleansing agent. In one embodiment, the emulsifier is a nonoxynol emulsifier and provided in a range of about between 3% and 15% of the cleanser. The water is provided in an amount to complete the cleansing agent and make it a desired consistency.

In one embodiment, the solvent is glycol ether PM acetate ester.

The cleansing agent is mixed with the solvent, thinning the cleansing agent to a desired consistency to complete the composition. In one embodiment, the composition is provided wherein the cleansing agent is in an amount of between about 25% and 75% of the composition and the solvent between about 75% and 25%. In another embodiment, the two components mixed in about equal amounts.

In another embodiment of the invention, a method is provided for cleaning dried ink and other contaminants from a plurality of cells and a surface of a print roller. The method includes the step of providing a composition including a cleansing agent and a solvent. The cleansing agent is provided comprising an emulsifier, a plurality of grit particles, an organic acid and water. The method next includes selecting an applicator suitable for wiping the roller surface and suitable for use with the composition. The composition is then thoroughly mixed to disperse the grit particles evenly. The composition is then wiped repeatedly over the print roller using the applicator until the surface and cells are substantially free of dried ink and other contaminants.

These and other objects, features and advantages of the invention will become apparent to those skilled in the art from the following detailed description and accompanying drawings. It should be understood, however, that the detailed description of the specific examples, while indicating preferred embodiments of the present invention, are given by way of illustration and not of limitation. Many changes and modifications may be made within the scope of the present invention and without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Figure 1:
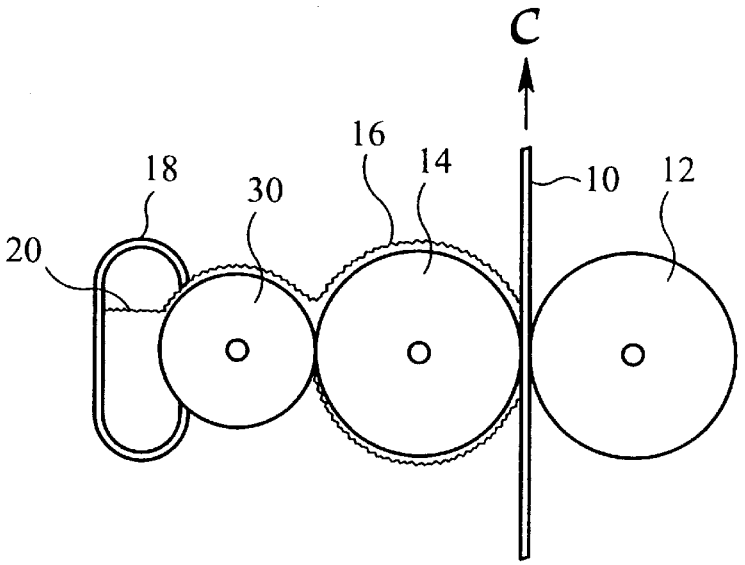
FIG. 1 illustrates a schematic view of a flexographic printing process.

FIG. 1 illustrates a schematic of the flexographic printing process wherein a web 10 of material is moved by a flexographic printing machine (not shown) in a direction "C" and rests on one side against an impression cylinder 12 which supports the web. A plate cylinder 14 is disposed on the opposite side of the web 10 and carries on its external surface a plurality of relief image plates 16. The image plates provide the printed images to be transferred onto the web from the plate cylinder 14. A fluid supply reservoir 18 carries a supply of fluid 20, typically of the solvent or water based fast drying fluid ink variety. The fluid 20 is transferred from the reservoir 18 to the plate cylinder 14 by a print roller or cylinder known in the art as an anilox roll or roller 22. The size and construction of the anilox roller 22 can vary greatly but must provide a highly precise volume of fluid such as ink delivered to the plate cylinder 14 in order to produce high definition, resolution and quality images on the web 10.

Figure 2:
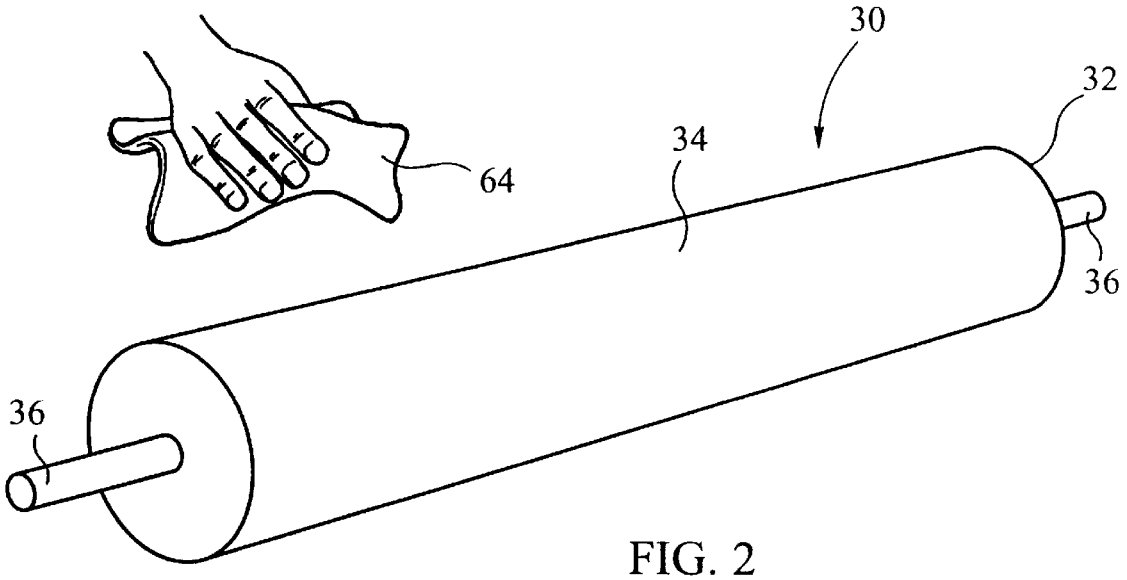
FIG. 2 illustrates a perspective view of a conventional anilox roller.

FIG. 2 illustrates a perspective view of a conventional anilox roller construction. An anilox roller 30 includes an elongate metal circular cylinder 32 typically machined from a solid bar of steel or other metal. The cylinder 32 has an outer surface that carries thereon a laser engraved ceramic coating 34. A shaft extension 36 extends from each end of the cylinder 32 for connection to appropriate associated components of a flexographic printing machine or the like. The shafts 36 are typically carried by journal bearings such that the roller 30 rotates about the shafts 36 in the machine.

Figure 3:
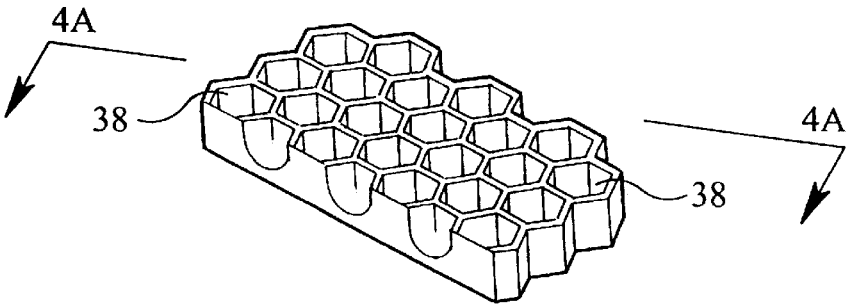
FIG. 3 illustrates a perspective view of a surface of a ceramic laser formed anilox roller in an enlarged view.

FIG. 3 illustrates an enlarged view of a portion of the ceramic coating 34 carried on the cylinder 32. A plurality of cells 38 are laser engraved in the surface of the ceramic coating 34 of the cylinder 32. The laser engraved anilox roller typically consists of a plasma-sprayed ceramic coating which is typically a chromium oxide, that is ground and honed to an extremely smooth finish. The ceramic coating is extremely hard, having a micro-hardness on the order of 1100–1300 Vickers. In comparison, the hardness of the less attractive chrome plating anilox rollers is around 850–950 Vickers. Other types of anilox rollers are steal rollers having a knurled surface to form the cells. Alternatively, a knurled surface has a ceramic coating or a chrome plated ceramic surface defining the cells. The present invention is not to be limited to the particular construction of an anilox roller described. However, the invention is particularly useful for the laser engraved anilox roller because of the very fine definition and high density of cells.

Figure 4A:
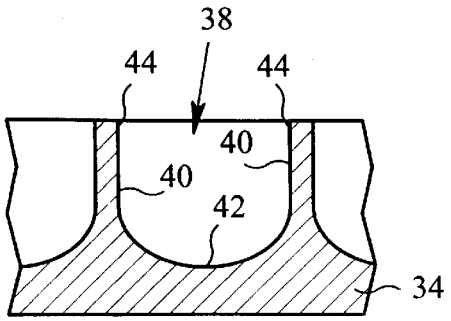
FIGS. 4*a* and 4*b* illustrate a cross-section of a cell of the anilox roller of FIG. 3 in an enlarged condition wherein the cell is plugged (4*b*) and wherein the cell is clean (4*a*)
Figure 4B:
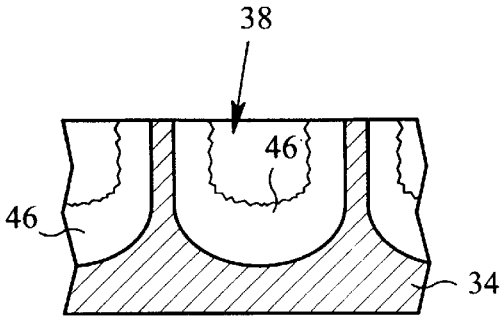

The shape, depth, diameter and particular wall thickness of the cell construction for an anilox roller can vary considerably depending upon the particular printing requirements of the flexographic printing process and upon the type of ink and amount of ink utilized for a particular process. The embodiment illustrated in FIG. 3 shows a typical honeycomb construction for the cells. FIG. 4*a* illustrates a cross-section through one of the cells wherein the cell is clean and free of dried ink and other material residue. The cell 38 includes a cell wall 40, a cell bottom and an upper cell opening 44. FIG. 4*b* illustrates the cell 38 in a plugged condition wherein ink residue 46 is disposed in the bottom 42 of the cell as well as along a portion of the walls 40 of the cell. The amount of residue 46 determines the actual volume size of the particular cell 38 wherein the more residue disposed within the cell the less the ink volume of the cell. Thus, the residue 46 reduces the volume of the cell, which in turn alters the ink carrying capabilities of the roller. A particular cell volume of the clean cell 38 is specifically designed to achieve a particular print characteristic and therefore must be kept clean in order to maintain the precise print qualities.

The present invention is directed to a chemical composition and a method for utilizing the chemical composition for cleaning dried ink and contaminants from print rollers. The invention is particularly useful for cleaning a ceramic coated anilox roller with laser engraved cells. The invention permits cleaning that is quick, inexpensive and simple in comparison to other known methods and apparatuses for cleaning such rollers. The composition generally comprises a soap or cleansing agent having a creme consistency mixed with a solvent.

The solvent is mixed with the cleansing agent to produce a thinner composition consistency. The solvent also aids in wetting the dried ink on the roller and in leaving the roller clean of both ink as well as the cleansing agent during cleaning of the roller. In one embodiment, the solvent is an ester in the form of glycol ether PM acetate, which is manufactured and is readily available from many different sources such as MILSOLV® Corp.

The soap or cleansing agent in one embodiment is comprised of a number of different constituents. The general components of the cleansing agent include a plurality of solid grit particles, an organic acid, an emulsifier and water. The cleansing agent is mixed with the solvent to complete the composition.

The grit particles are provided as an abrasive agent for breaking up the dried ink or other material embedded in the cells 38 and dried on the ceramic coating 34 of the roller 30. The size and shape of the particles should be effective to thoroughly work the surface and cells of the roller and yet prevent the particles from becoming lodged within the cells of the roller. In one embodiment, the grit particles are provided in an amount of at least about 10% of the cleansing agent by weight. In another embodiment, the grit particles are provided in an amount of at least about 20% or more of the cleansing agent by weight.

The grit particles in one embodiment are silica particles. However, the particles can be provided from other materials as well without departing from the scope of the invention. The particle material must be of a type that does not damage the ceramic coating or cell walls and yet does not dissolve in the composition and adequately loosens the dried ink and other contaminants left on the roller 30. Aside from silica, other possible particle materials include but are not limited to metallic, carbide, and composite materials.

The organic acid is provided in an amount that is sufficient to assist in wetting, loosening and/or breaking up the dried ink and contaminants left on the roller and in the cells. In one embodiment, the organic acid of the cleansing agent is a sulfonicacid, such as dodecyl benzyl sulfonicacid, provided in a range of between about 3% to about 15% of the cleansing agent by weight. The sulfonicacid in one embodiment is dodecyl benzyl sulfonicacid, provided in a range of between about 5% to about 10% of the cleansing agent by weight.

The emulsifier suspends the grit particles, organic acid and other possible components of the cleansing agent in the water and helps to keep the components suspended in the solvent when mixed with the cleansing agent. The emulsifier, such as nonexynol, is also provided in a range from between about 3% to about 15% of the cleansing agent. In one embodiment, the emulsifier is a nonoxynol emulsifier provided in a range of between about 5% to about 10% by weight or molecular mass of the cleansing agent. The emulsifier is utilized in the cleanser to suspend particles relatively evenly within the cleansing agent so as to provide an even distribution of these active agents throughout the cleansing agent.

Water is added to the cleansing agent to provide the components with a desired consistency. In one embodiment, the water is provided in an amount of between about 20% to about 80% of the cleansing agent, depending upon the desired consistency and the particular components used for the cleansing agent. The higher the water content of the cleansing agent, the lower its viscosity. Preferably, the water is provided in an amount of about 40% of the cleansing agent providing a creme consistency.

Ammonium chlorides can also be added to the cleansing agent as well. Ammonium chlorides are somewhat hygroscopic so as to absorb ink and other contaminants removed from the roller surface and cells. In one embodiment, one or two ammonium chlorides are added in an amount of up to about 0.10% of the cleansing agent. In one embodiment, n-alkyl dimethyl benzyl and n-alkyl dimethyl ethyl benzyl ammonium chlorides are preferably provided, each in a small amount of up to about 0.05% of the cleansing agent by weight. Preferably, each is provided in an amount of about 0.026% of the cleansing agent by weight. In one preferred embodiment, the dimethyl benzyl ammonium chloride comprises about 60% C14, 30% C16, 5% C12 and 5% C18. The dimethyl ethyl benzyl ammonium chloride preferably comprises 68% C12 and 32% C14.

The cleansing agent in a crème consistency is then mixed with the solvent to complete the composition. In a preferred embodiment, the cleansing agent is provided in an amount of between 25% and 75% by volume and mixed with the acetate in an appropriate amount to complete the composition. In one particular embodiment, the two components are mixed in generally equal amounts or 50/50 by volume. The composition has a consistency of a watery or thin liquid.

Because of the thin consistency, the composition separates fairly quickly with the grit particles and other components settling to the bottom of a container. The container is preferably provided with a mixing ball to agitate the components and re-mix them each time the composition is to be used. The composition must therefor be shaken vigorously prior to each use in order to work properly.

Figure 5:
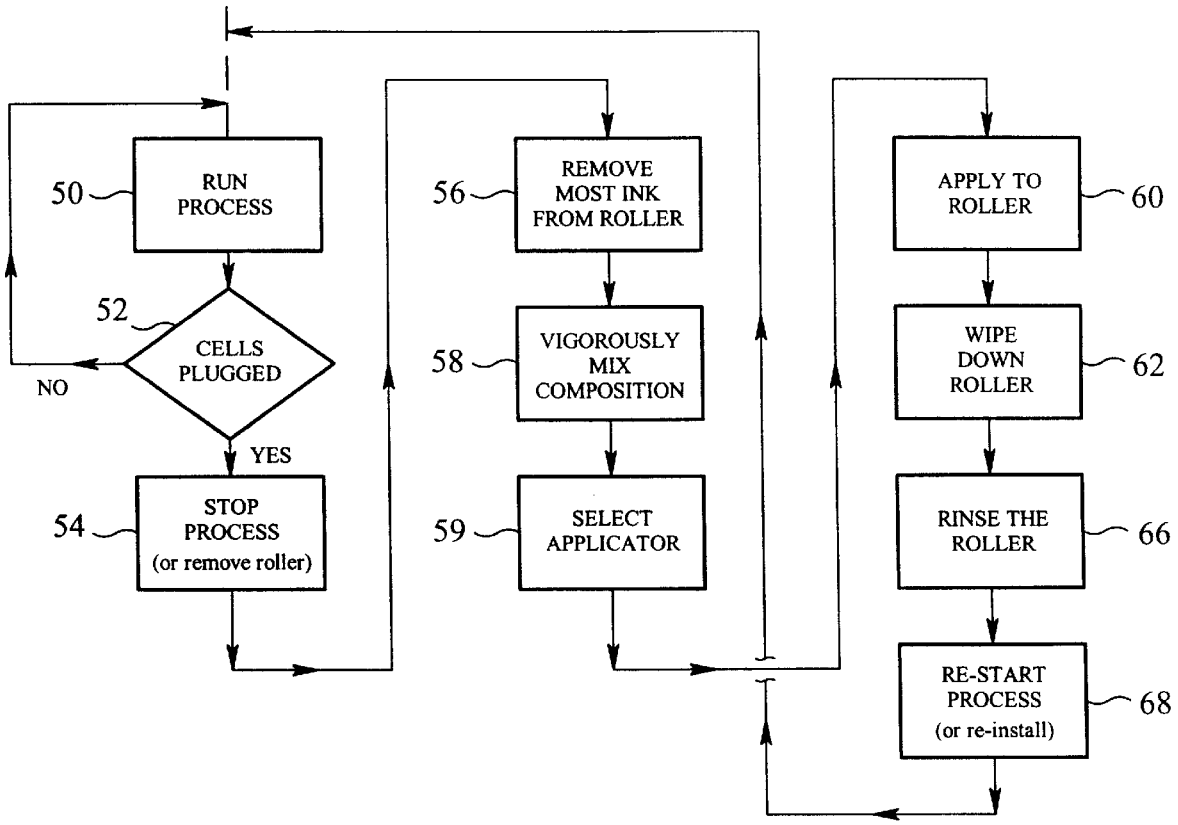
FIG. 5 illustrates a flow chart of one method of cleaning the anilox roller illustrated in FIG. 2 according to the invention.

FIG. 5 illustrates a flow chart of a method for cleaning an anilox roller according to the invention and using the above-described composition. A printing machine (not shown) is run as indicated by block 50. A periodic determination or evaluation is made whether the cells of the anilox roller are plugged and must be cleaned as indicated by block 52. Such an evaluation can be made using one of many ways including simply visually inspecting the roller or visually inspecting either the print quality or the ink film transfer quality. More elaborate methods are available that automatically measure the cell volume, the fluid or ink film thickness, or a characteristic of the printed image. The invention is not to be limited in any manner by the type of determination utilized. The printing process or machine may also simply be ready for a change-over requiring either an alternate anilox roller or a clean roller for a different print job. The removed roller can be inspected and/or cleaned either while the machine is down or while running with an alternate roller.

Next, when a roller cleaning is necessary or possible, the machine is temporarily stopped as indicated by block 54 so that the roller can be cleaned on the machine. Alternatively, the roller may be removed from the machine for cleaning. Regardless of whether the roller is cleaned on the machine or cleaned after removal, the invention speeds up the cleaning process because the method is much faster than using previously known methods or compositions.

Next, the roller is preliminarily wiped down to remove most of the wet ink from the last run printing process as indicated by block 56. The composition is then vigorously shaken to thoroughly mix the components as indicated by biock 58. An applicator is then selected for cleaning the roller indicated by block 59. The applicator can be a conventional cloth such as a reusable shop towel or any other suitable applicator capable of absorbing and carrying some of the composition if so desired. The applicator must also be of a type that can withstand contact with the composition and withstand repeated application of force while wiping down the roller.

Next, as indicated by block 60, the composition is applied to the roller. The composition can either be applied to the applicator first and then applied to the roller or, alternatively, can be applied directly to the roller.

Next, the roller is wiped down as indicated at block 62. The roller is preferably wiped using the applicator until all of the dried ink and other residue within the plugged cells 38 and on the surface 34 is loosened, removed and collected on the applicator. An applicator 64 held in a user's hand is schematically shown in FIG. 3 for illustrative purposes. Once the roller is sufficiently wiped down and cleaned, the roller should be rinsed with water or some other rinsing agent as indicated at block 66 to remove any of the composition remaining on the roller. Once rinsed, the roller is ready to be utilized in the printing process as indicated by block 68.

To put it simply, the roller is easily wiped down with a cloth using the composition of the invention. The composition completely and deeply cleans the surface 34 and the cells 38 of the anilox roller. The composition begins to work immediately, so no dwell time or wait time is necessary before wiping down the roller. Additionally, the composition of the invention provides a vast improvement in completely cleaning dried ink from the cells when compared to known manual cleaning compositions and methods. Further, no expensive equipment is required as with most methods used for cleaning anilox rollers.

A commercially available cleansing agent or soap that is particularly well suited for the invention is known as Disinfecting Crème Cleanser manufactured by Colgate-Palmolive Co. under the Trade name AJAX. Other suitable creme cleansers or cleansing agents are also commercially available.

The invention greatly reduces the machine downtime, the roller cleaning time, the cost and complexity of cleaning anilox rollers, and yet provides a completely clean, undamaged and re-usable anilox roller having no dried ink or other dried or hardened substances in the cells. The composition is equally useful on water based, solvent based and ultraviolet drying inks.

The composition as described can have a strong unpleasant odor. A deodorizer or fragrant substance can be added to alter the composition's odor in order to make the odor less unpleasant or even pleasant. One example of a deodorizer is known as Formula 150090 Bouquet DL 50 that can be included in the inventive composition. A small amount of about 0.03 to 0.04% of the deodorizer was found to be effective.

Many changes and modifications can be made to the invention without departing from the spirit and scope thereof. The scope of some of these changes is discussed above whereas other changes will be come apparent upon a careful reading of the specification and appended claims. The scope of the invention is therefor to be limited only by the appended claims.

What it is claimed is:

1. A composition for cleaning a plurality of cells and a surface of an ink metering print roller, the composition comprising:

glycol ether PM acetate solvent in a range of between about 25% and about 75% of the composition; and a cleansing agent in a range of about 75% and about 25% of the composition, the cleansing agent including a nonoxynol emulsifier in a range of between about 3% and about 15% of the cleansing agent, dodecyl benzyl sulfonicacid in an amount of between about 3% and about 15% of the cleansing agent, a plurality of grit particles in an amount of at least about 10% of the cleansing agent, said grit particles being selected from the group consisting of silica, metallic and carbide particles, and water in an amount to complete the cleansing agent.

2. The composition according to claim 1, wherein the solvent is about 50% of the composition and the cleansing agent is about 50% of the composition.

3. The composition according to claim 1, wherein the grit particles are silica particles.

4. The composition according to claim 3, wherein the silica particles are in an amount of at least 20% of the cleansing agent.

5. The composition according to claim 1, wherein the nonoxynol emulsifier is in an amount of between about 5% to about 10% of the cleansing agent.

6. The composition according to claim 1, wherein the sulfonicacid is in a range of between about 5% to about 10% of the cleansing agent.

7. The composition according to claim 1, wherein the cleansing agent further comprises:

at least one ammonium chloride in an amount of up to about 0.10% of the cleansing agent, the at least one ammonium chloride selected from n-alkyl dimethyl benzyl ammonium chloride and n-alkyl dimethyl ethyl benzyl ammonium chloride.

8. The composition according to claim 7, further comprising:

n-alkyl dimethyl benzyl ammonium chloride in an amount of up to 0.05% of the cleansing agent; and n-alkyl dimethyl ethyl benzyl ammonium chloride in an amount of up to about 0.05% of the cleansing agent.

9. The composition according to claim 8, wherein the n-alkyl dimethyl benzyl ammonium chloride is in an amount of about 0.026% of the cleansing agent and the n-alkyl dimethyl ethyl benzyl ammonium chloride is in an amount of about 0.026% of the cleansing agent.

10. The composition according to claim 1, further comprising:

a deodorizer to alter an odor of the composition.

11. A method of cleaning a plurality of cells and a surface of an ink metering print roller, the method comprising the steps of:

providing a composition including glycol ether PM acetate solvent in a range of between about 25% and about 75% of the composition, and a cleansing agent in a range of about 75% and about 25% of the composition, the cleansing agent including a nonoxynol emulsifier in a range of between about 3% and about 15% of the cleansing agent, dodecyl benzyl sulfonicacid in an amount of between about 3% and about 15% of the cleansing agent, a plurality of grit particles in an amount of at least about 10% of the cleansing agent, said grit particles being selected from the group consisting of silica, metallic and carbide particles and water in an amount to complete the cleansing agent;

selecting an applicator;

thoroughly mixing the composition; and wiping the composition repeatedly over the print roller using the applicator until the surface and the plurality of cells are substantially free of dried ink and other contaminants.

12. The method according to claim 11, wherein the steps of applying and wiping are carried out while the anilox roller remains installed in a flexographic printing apparatus.

13. The method according to claim 11, further comprising the step of rinsing the anilox roller with water after the step of wiping.

* * * * *